US009454111B2

(12) United States Patent
Hatazaki

(10) Patent No.: US 9,454,111 B2
(45) Date of Patent: Sep. 27, 2016

(54) IMAGE HEATING APPARATUS WITH CLEANING WEB CONFIGURED TO CLEAN COLLECTING ROLLER

(71) Applicant: CANON KABUSHIKI KAISHA, Tokyo (JP)

(72) Inventor: Kazunari Hatazaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/640,284

(22) Filed: Mar. 6, 2015

(65) Prior Publication Data

US 2015/0253701 A1 Sep. 10, 2015

(30) Foreign Application Priority Data

Mar. 10, 2014 (JP) ..... 2014-045862

(51) Int. Cl.
*G03G 15/20* (2006.01)

(52) U.S. Cl.
CPC ..... *G03G 15/2025* (2013.01)

(58) Field of Classification Search
USPC ..... 399/34, 71, 123, 129, 320, 326, 327, 399/329
See application file for complete search history.

(56) References Cited

U.S. PATENT DOCUMENTS 8,929,794 B2 1/2015 Hatazaki
2014/0064801 A1* 3/2014 Shibaki ..... G03G 15/2075 399/327
2014/0193181 A1* 7/2014 Nakamura ..... G03G 15/2025 399/327
2014/0270866 A1 9/2014 Hatazaki
2014/0270867 A1 9/2014 Hatazaki
2014/0270868 A1 9/2014 Chiyoda et al.
2014/0369726 A1 12/2014 Soeda
2015/0220045 A1* 8/2015 Hatazaki ..... G03G 21/0041 399/327

(Continued)

FOREIGN PATENT DOCUMENTS

JP 6-194986 7/1994
JP 11-38816 A 2/1999

(Continued)

OTHER PUBLICATIONS

U.S. Appl. No. 14/632,330, dated Feb. 26, 2015.

(Continued)

*Primary Examiner* — Benjamin Schmitt
*Assistant Examiner* — Matthew Miller
(74) *Attorney, Agent, or Firm* — Fitzpatrick, Cella, Harper & Scinto

(57) ABSTRACT

An image hearing apparatus includes: a rotatable heating member; a rotatable collecting member; a cleaning unit including a cleaning web; a moving mechanism configured to move the cleaning unit between a first position where the cleaning web contacts the rotatable collecting member and a second position where the cleaning web contacts the rotatable collecting member at a contact pressure lower than a contact pressure at the first position; and an urging portion. The cleaning unit also includes a first pressing potion configured to press the rotatable collecting member toward the rotatable heating member in contact with the rotatable collecting member when the cleaning unit is in the first position, and includes a second pressing portion configured to press the rotatable collecting member toward the rotatable heating member in contact with the urging portion without contacting the rotatable collecting member when the cleaning unit is in the second position.

7 Claims, 8 Drawing Sheets

(56) References Cited

U.S. PATENT DOCUMENTS

| | | | | |
|---|---|---|---|---|
| 2015/0234342 | A1* | 8/2015 | Hatazaki | G03G 21/0041 399/327 |
| 2015/0253700 | A1* | 9/2015 | Hatazaki | G03G 15/2039 399/327 |

FOREIGN PATENT DOCUMENTS

| | | | |
|---|---|---|---|
| JP | 2002-189373 | A | 7/2002 |
| JP | 2004-212409 | | 7/2004 |
| JP | 2005-062801 | A | 3/2005 |
| JP | 2007-047450 | A | 2/2007 |
| JP | 2008-040310 | A | 2/2008 |
| JP | 2008-129138 | A | 6/2008 |
| JP | 2014-134626 | A | 7/2014 |

OTHER PUBLICATIONS

U.S. Appl. No. 14/632,330, filed Feb. 26, 2015, Kazunari Hatazaki.

* cited by examiner (a)

(b)

IMAGE HEATING APPARATUS WITH CLEANING WEB CONFIGURED TO CLEAN COLLECTING ROLLER

FIELD OF THE INVENTION AND RELATED ART

The present invention relates to an image heating apparatus. This image heating apparatus is used in an image forming apparatus such as a copying machine, a printer, a facsimile machine and a multi-function machine having a plurality of functions of these machines.

In a conventional image forming apparatus of an electrophotographic type, a toner image formed on a recording material is fixed by a fixing device (image heating apparatus).

In such a fixing device, e.g., in the case where a jam is generated, there is a liability that a large amount of toner is offset on a fixing roller (rotatable heating member), and therefore a mechanism for cleaning the fixing roller is provided (Japanese Laid-Open Patent Application (JP-A) Hei 6-194986). Specifically, a constitution in which the fixing roller is cleaned using a cleaning web is employed.

Further, there is a liability that the fixing roller is damaged by foreign matter sandwiched between the fixing roller and the web, and therefore a constitution in which a collecting roller is interposed between the fixing roller and the web has been proposed (JP-A 2004-212409). Specifically, the offset toner is once collected from the fixing roller onto the collecting roller, and then the collected offset toner is cleaned with the web.

However, in the case where the toner is offset by a large amount on the fixing roller with the generation of the jam, in order to resume image formation quickly, the larger amount of offset toner is required to be removed in a short time.

SUMMARY OF THE INVENTION

According to an aspect of the present invention, there is provided an image hearing apparatus comprising: a rotatable heating member configured to heat a toner image on a recording material; a rotatable collecting member configured to collect a toner deposited on the rotatable heating member while being rotated by the rotatable heating member; a cleaning unit including a cleaning web configured to clean the rotatable collecting member; a moving mechanism configured to move the cleaning unit so as to be movable between a first position where the cleaning web contacts the rotatable collecting member and a second position where the cleaning web contacts the rotatable collecting member at a contact pressure lower than a contact pressure at the first position; and an urging portion configured to urge the rotatable collecting member toward the rotatable heating member. The cleaning unit also includes a first pressing potion configured to press the rotatable collecting member toward the rotatable heating member in contact with the rotatable collecting member when the cleaning unit is in the first position, and includes a second pressing portion configured to press the rotatable collecting member toward the rotatable heating member in contact with the urging portion without contacting the rotatable collecting member when the cleaning unit is in the second position.

According to another aspect of the present invention, there is provided an image hearing apparatus comprising: a rotatable heating member configured to heat a toner image on a recording material; a rotatable collecting member configured to collect a toner deposited on the rotatable heating member while being rotated by the rotatable heating member; a cleaning unit including a cleaning web configured to clean the rotatable collecting member; and a moving mechanism configured to move the cleaning unit so as to be movable between a first position where the cleaning web contacts the rotatable collecting member and a second position where the cleaning web contacts the rotatable collecting member at a contact pressure lower than a contact pressure at the first position. When the cleaning unit is in the first position or in the second position, the frictional force between the rotatable collecting member and the rotatable heating member is larger than the frictional force between the cleaning web and the rotatable collecting member.

According to a further aspect of the present invention, there is provided an image hearing apparatus comprising: a rotatable heating member configured to heat a toner image on a recording material; a rotatable collecting member configured to collect a toner deposited on the rotatable heating member while being rotated by the rotatable heating member; a cleaning unit including a cleaning web configured to clean the rotatable collecting member; and an urging portion configured to urge the rotatable collecting member toward the rotatable heating member. The cleaning unit includes a first pressing potion configured to press the rotatable collecting member toward the rotatable heating member in contact with the rotatable collecting member, and includes a second pressing portion configured to press the rotatable collecting member toward the rotatable heating member in contact with the urging portion without contacting the rotatable collecting member.

These and other objects, features and advantages of the present invention will become more apparent upon a consideration of the following description of the preferred embodiments of the present invention taken in conjunction with the accompanying drawings.

DESCRIPTION OF THE EMBODIMENTS

<First Embodiment>

A First Embodiment of the present invention will be described with reference to the drawings. In this embodiment, a constitution in which an image heating apparatus is used as a fixing device for fixing an unfixed toner image on a sheet (recording material) will be described, but the present invention can also be carried out as a heat treatment device for adjusting an image surface property by heating the recording material on which a fixed image or a partly fixed image is carried.

Incidentally, the dimensions, materials and shapes of constituent elements and their relative arrangements and the like described in the following embodiments should be changed appropriately depending on structures and various conditions of apparatuses (devices) to which the present invention is applied, and the present invention is not intended to be limited to the following embodiments.

Figure 1:
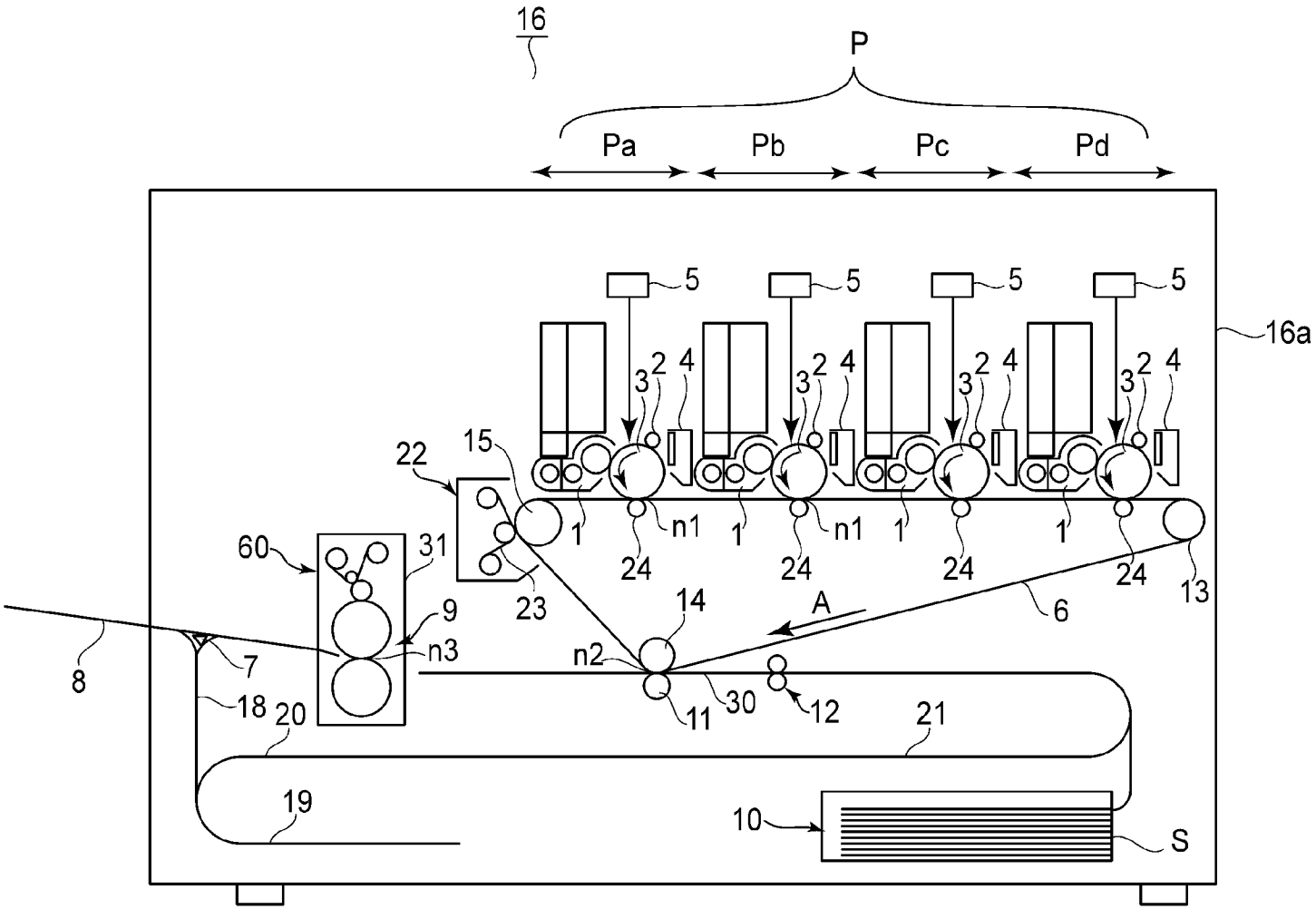
FIG. 1 is a schematic sectional view of an image forming apparatus in a First Embodiment.

First, a color electrophotographic printer as an image forming apparatus in this embodiment will be described with reference to FIG. 1. FIG. 1 shows the color electrophotographic printer in a state of a cross section along a feeding direction of the sheet. In the following embodiments, the color electrophotographic printer is simply referred to as a printer.

[Printer]

As shown in Embodiment 1, a printer 16 includes a printer main assembly 16*a* provided with image forming portions Pa, Pb, Pc and Pd corresponding to the colors of Y (yellow), M (magenta), C (cyan) and Bk (black), respectively. The image forming portions Pa, Pb, Pc and Pd are different in the colors of toners used as Y, M, C and Bk, respectively, but the same structure is employed. For this reason, these image forming portions will be described as a common image forming portion P.

The image forming portion P includes an electrophotographic photosensitive drum 3 and members, including a charger 2, a laser scanner 5, a developing device 1, a primary transfer roller 24 and a drum cleaner 4, which are provided in the listed order along a rotational direction of the photosensitive drum 3.

In each image forming portion P, the photosensitive drum 3 is electrically charged by the charger in advance, and thereafter an electrostatic latent image is formed by the laser scanner 5. In the laser scanner 5, unshown light source device and polygon mirror are provided. Laser light emitted from the light source device is used to scan the surface of the photosensitive drum 3 with the polygon mirror, and light fluxes of the scanning light is deflected by a reflection mirror and are focused on a generatrix of the photosensitive drum 3 by an unshown fθ lens to expose the photosensitive drum surface, so that the electrostatic latent image depending on an image signal is formed on the photosensitive drum 3.

Then, the electrostatic latent image is visualized as a toner image by the developing device 1. That is, in the developing device 1, as a developer, a toner of a corresponding color is filled in a predetermined amount by an unshown supplying device. Each developing device 1 develops the electrostatic latent image on the corresponding photosensitive drum 3, and thus visualizes the electrostatic latent image as the toner image of the corresponding color.

The toner used in this embodiment contains (incorporates), a wax consisting of paraffin or polyolefin, or a silicone oil as a parting agent. Specifically, in this embodiment, a toner obtained by finely dispersing a wax component and a pigment into a pulverized toner is used. A constitution in which a polymerization toner containing such a wax component is used may also be employed. In the following description, as the parting agent, the wax is described as an example, but as described above, also the case where the silicone oil is used as the parting agent is similarly applied.

The toner images, corresponding to the associated colors, formed on the respective photosensitive drums 3 are successively primary-transferred onto an intermediary transfer belt 6 as an image bearing member by primary transfer rollers 24. That is, in a process in which the toner image formed and carried on the associated photosensitive drum 3 passes through a primary transfer nip n1 between the photosensitive drum 3 and the intermediary transfer belt 6, the toner image is intermediately transferred onto an outer peripheral surface of the intermediary transfer belt 6 by pressure and an electric field formed by a primary transfer bias applied to the intermediary transfer belt 6. After this primary transfer, a transfer residual toner remaining on the photosensitive drum 3 is removed by cleaning with the drum cleaner 4, and therefore the surface of the photosensitive drum 3 is cleaned and can prepare for subsequent image formation.

On the other hand, a recording material S is fed one by one from a sheet feeding cassette 10 and then is sent into a registration roller pair 12. The registration roller pair 12 once receives the recording material S and corrects oblique movement of the recording material S. Then, the registration roller pair 12 sends the recording material to a secondary transfer nip n2 between the intermediary transfer belt 6 and a secondary transfer roller 11 in synchronism with the toner image on the intermediary transfer belt 6. The intermediary transfer belt 6 is constituted so that the intermediary transfer belt 6 is rotatable at the same peripheral speed as those of the photosensitive drums 3 in an arrow A direction by stretching rollers 13, 14 and 15.

The color toner images on the intermediary transfer belt 6 are secondary-transferred onto the recording material S at the secondary transfer nip n2 by the secondary transfer roller 11. The secondary transfer roller 11 is shaft-supported in parallel with the intermediary transfer belt 6 correspondingly to the intermediary transfer belt 6, and is supported in a state in which the secondary transfer roller 11 contacts a lower surface of the intermediary transfer belt 6. To the secondary transfer roller 11, a desired secondary transfer bias is applied by a secondary transfer bias (voltage) source (not shown). The secondary transfer, onto the recording material S, of the four color toner images superposedly transferred as a synthetic color toner image is carried out in the following manner. That is, the recording material S fed from the sheet feeding cassette 10 passes through the registration roller pair 12 and a pre-transfer guide 30 and then is fed to the secondary transfer nip n2 at predetermined timing, and at the same time, the secondary transfer bias is applied from the bias (power) source to the secondary transfer roller 11, whereby the secondary transfer is carried out.

By this secondary transfer bias, the synthetic color toner image is secondary-transferred from the intermediary transfer belt 6 onto the recording material S. The synthetic color toner image is formed on the recording material S while leaving a certain in margin from each of four edges of the recording material S. In this embodiment, a leading end portion margin is about 2-3 mm. A transfer residual toner and another foreign matter are wiped off by rubbing the surface of the intermediary transfer belt 6 with a cleaning web 23 consisting of a nonwoven fabric in a belt cleaner 22.

Then, the recording material S on which the toner images are secondary-transferred is introduced successively into a heating nip n3 of the fixing device 9, so that the toner images on the recording material (sheet) S is fixed by being heated and pressed at the heating nip n3. As a specific example of the recording material S on which the toner image is to be formed, it is possible to use plain paper, a resin-made sheet material as an alternative to the plain paper, thick paper, a recording material for an overhead projector, and the like.

In the case where the toner image is formed on one surface of the recording material S, depending on a condition, a feeding path is switched by a switching member (flapper) 7. On the other hand, in the case where the toner image is formed on double (both) surfaces of the recording material S, the recording material S on which the toner image is fixed by the fixing device 9 is guided onto a discharge tray 8 by the switched switching member 7. Then, when a trailing end of the recording material S reaches a reversing point, the recording material S is fed along switch-back feeding paths 18, 19 and 20 in a switch-back manner, and is turned upside down. Thereafter, the recording material S is fed along a feeding path 21 for double-side printing, and then is subjected to the same process as that during one-side image formation (printing), so that the toner image is formed on the other (back) surface, and then is discharged on the discharge tray 8.

Incidentally, in the case of a printer having a monochromatic (Bk single color) structure, only the photosensitive drum 3 for black in the above-described exists, and the toner image formed on the photosensitive drum 3 is constituted s as to be transferred onto the recording material by the transfer device.

The fixing device 9 in this embodiment has a constitution in which the toner image formed on the recording material S by using the toner containing the parting agent is fixed on the recording material S by being heated and pressed. The constitution will be specifically described.

[Fixing Device]

Figure 2:
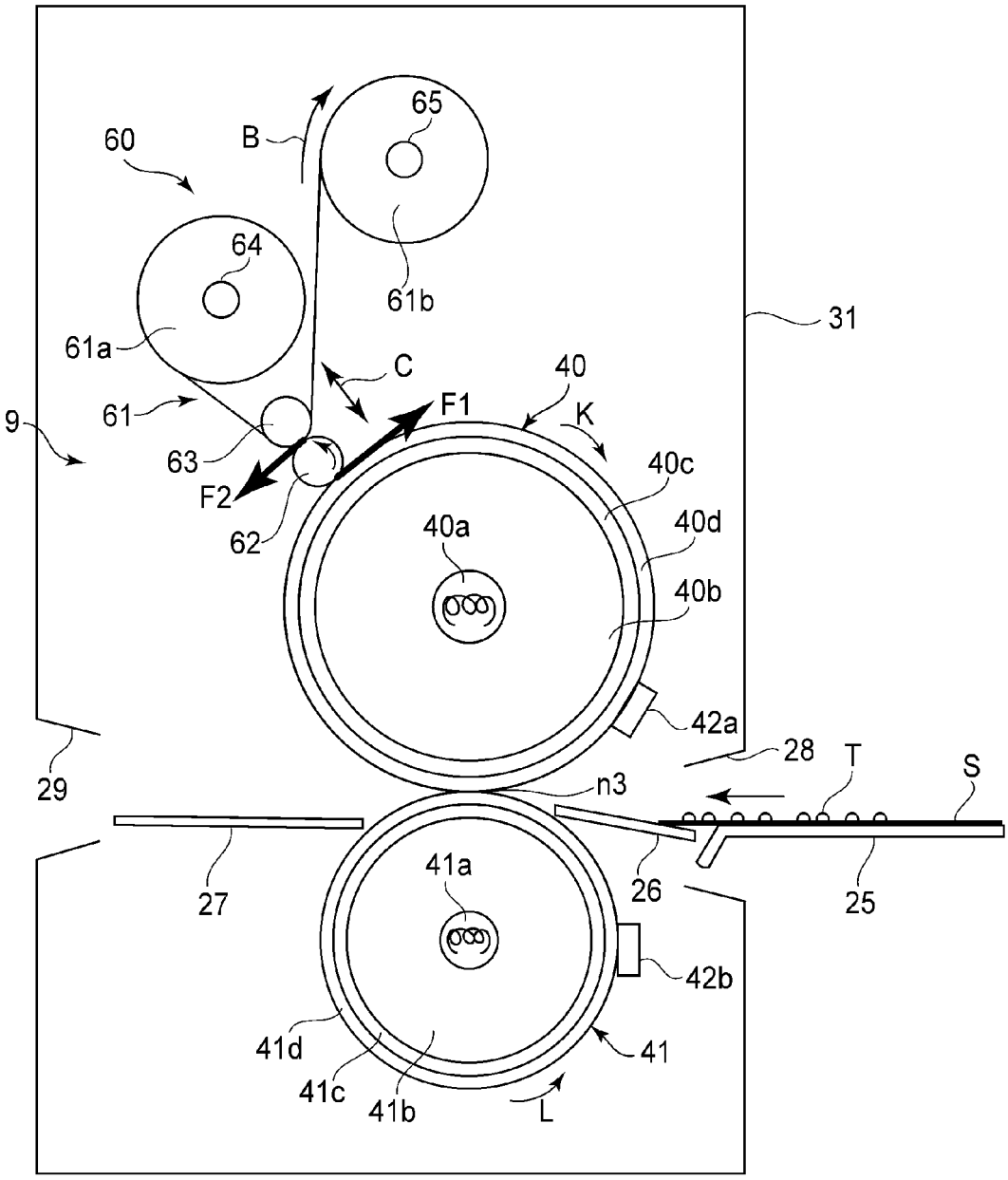
FIG. 2 is a sectional view showing a structure of a fixing device in the First Embodiment.
Figure 3:
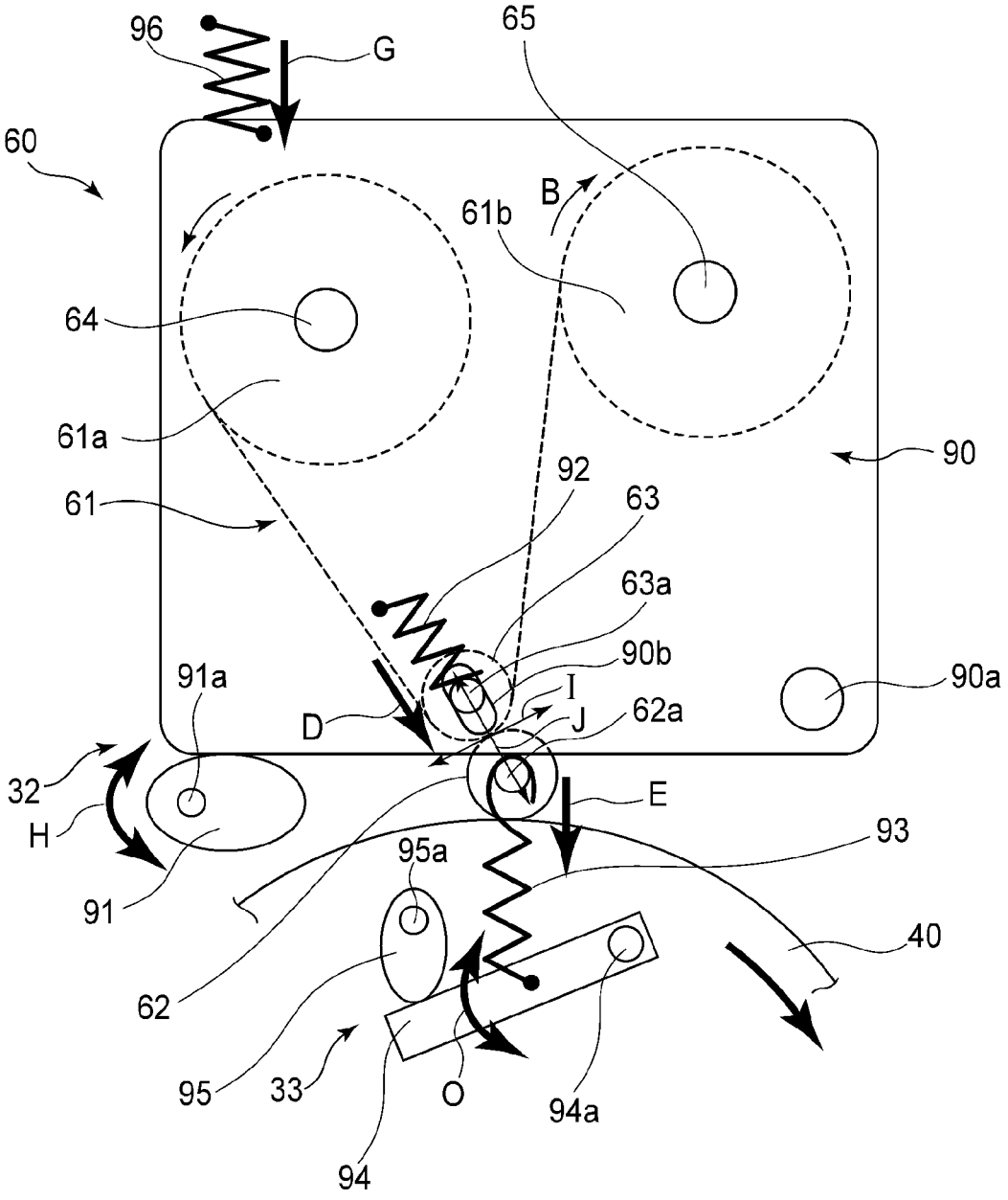
FIG. 3 is a schematic view showing a moving mechanism for moving a web roller toward and away from a collecting roller in the First Embodiment.
Figure 4:
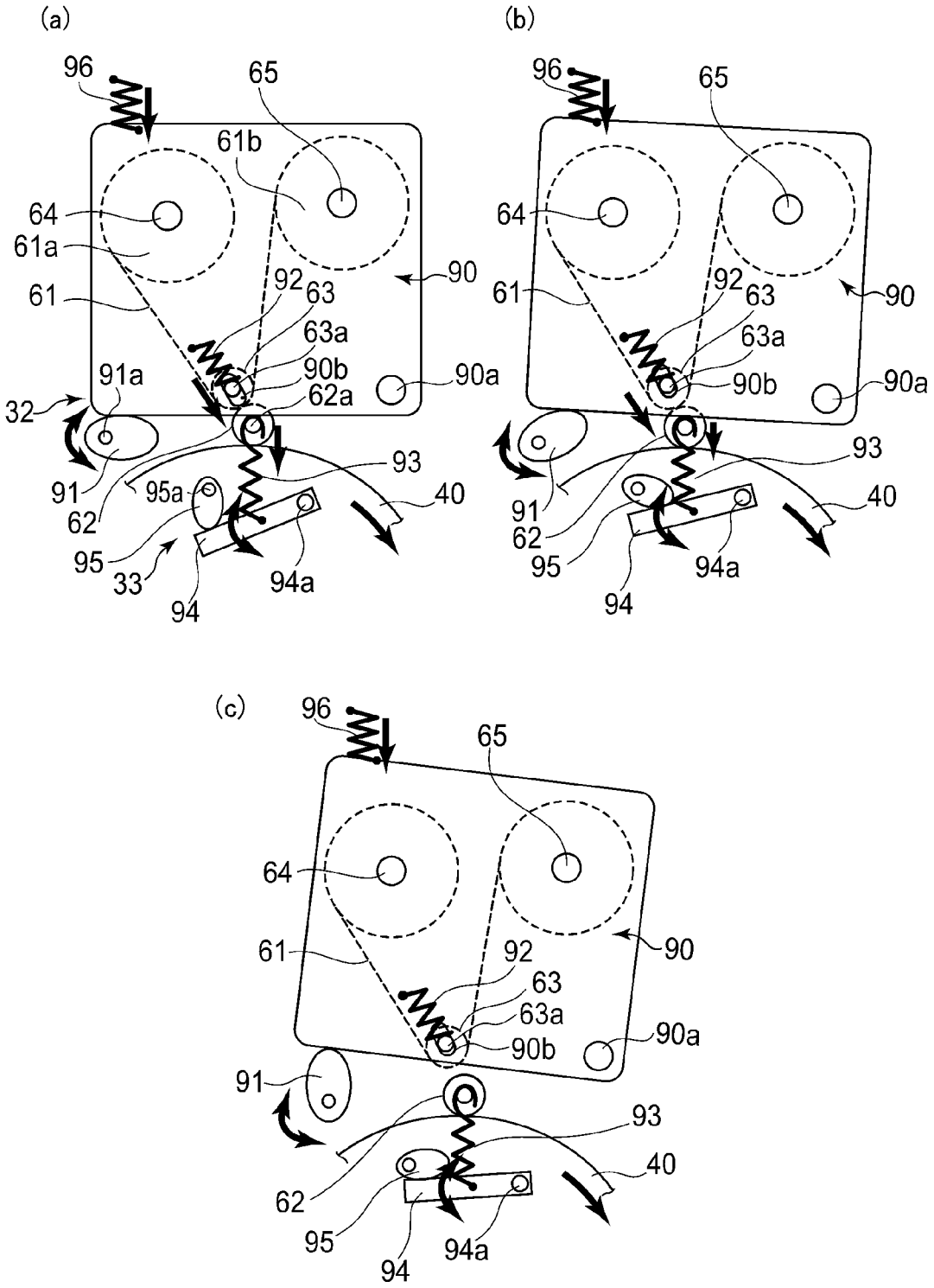
In FIG. 4,(*a*) to (*c*) are schematic views each showing a state of the mounting means for the collecting roller and the web roller at a the position in the First Embodiment.

Next, the fixing device 9 as the image heating apparatus will be described with reference to FIGS. 2 to 4. FIG. 2 is a sectional view showing a structure of the fixing device 9 in this embodiment, FIG. 3 is a schematic view showing a moving mechanism 32 for moving a web roller 63 toward and away from a collecting roller 62, and (a) to (c) of FIG. 4 are schematic views each showing a state of the moving mechanism 32 at a position.

As shown in FIG. 2, inside a casing 31 supported in the printer main assembly 16*a*, the fixing device 9 including a cleaning unit 60 provided at an upper portion is disposed. The cleaning unit 60 includes, as described later, a cleaning web 61 for cleaning a collecting roller 62 as a rotatable collecting member by slide with the collecting roller 62. In the fixing device 9, an opposite roller 41 as a rotatable opposite member is press-contacted to a fixing roller 40 as a rotatable heating member, for heating a toner image on the recording material, at a total pressure of, e.g., about 784 (N) (about 80 (kg)), so that the heating nip n3 of the recording material S is formed.

In this way, the opposite roller (rotatable opposite member) 41 is contacted to the fixing roller (rotatable heating member) 40, so that the heating nip n3 for heating the image (toner image) on the recording material S. In the fixing device 9, the (unfixed) toner image T secondary-transferred on the recording material S is nipped and fed in the heating nip n3 between the fixing roller 40, to be contacted to the image surface, and the opposite roller 41, and thus is fixed on the recording material S. Referring to FIG. 2, in front of the develop 9, pre-fixing guides 25 and 26 are provided, and behind the fixing device 9, a post-fixing guide 27 is provided. Further, the recording material S is fed into the fixing device 9 through an entrance opening 28 and comes out of the fixing device 9 through an exit opening 29.

The fixing roller 40 is constituted as a cylindrical shape having, e.g., a diameter of 60 mm by disposing, e.g., a 3 mm-thick elastic layer 40*c* on an outer peripheral surface of an aluminum cylindrical core metal 40*b*. A lower layer of the elastic layer 40*c* is a HTV (high-temperature vulcanizing) silicone rubber layer, and on an outer peripheral surface of the HTV silicone rubber layer, an RTV (room-temperature vulcanizing) silicone rubber layer as a heat-resistant elastic layer 40*d* to be contacted to the image surface is disposed.

On the elastic layer 40*c*, in order to improve a parting property with the toner, a fluorine-containing resin material (PFA tube in this embodiment) as a heat-resistant parting layer 40*d* is coated. Further, at a center portion of the core metal 40*b* of the fixing roller 40 a fixing roller heater 40*a* consisting of a halogen heater, having predetermined rated electric power, for heating the fixing roller 40 from an inside so that a surface temperature of the fixing roller 40 becomes a predetermined temperature is provided non-rotatably.

On the other hand, the opposite roller 41 disposed so as to oppose the fixing roller 40 is constituted as a cylindrical shape having, e.g., a diameter of 60 mm by disposing, e.g., a 1 mm-thick elastic layer 41*c* on an outer peripheral surface of an aluminum cylindrical core metal 41*b*. A lower layer of the elastic layer 41*c* is a HTV silicone rubber layer, and on an outer peripheral surface of the HTV silicone rubber layer, a fluorine-containing resin layer is disposed.

On the elastic layer 41*c*, in order to improve a parting property with the toner, a heat-resistant parting layer 41*d* is coated. Further, at a center portion of the core metal 41*b* of the opposite roller 41, an opposite roller heater 41*a* having predetermined rated electric power, for heating the opposite roller 41 from an inside so that a surface temperature of the opposite roller 41 becomes a predetermined temperature is provided non-rotatably.

In this embodiment, by combining the fixing roller 40 and the opposite roller 41 each having the above-described layer structure, the parting property against a sharp-melt toner is further improved. Further, in order to fix double-side images, not only at the surface of the fixing roller 40 but also at the surface of the opposite roller 41, the above-described parting layer (40*d* or 41*d*) of RTV or LTV (low-temperature vulcanizing) silicone rubber or the like having a high toner parting effect is provided.

Each of the fixing roller 40 and the opposite roller 41 is rotatably supported at end portions thereof by ball bearings (not shown). Each of the fixing roller 40 and the collecting roller 41 is provided with a gear (not shown) at one of shaft end portions thereof, and these gears of the rollers 40 and 41 are connected with each other by a gear mechanism (not shown), so that the rollers 40 and 41 are rotationally driven integrally by an unshown driving mechanism in arrow K and L directions, respectively.

Figure 5:
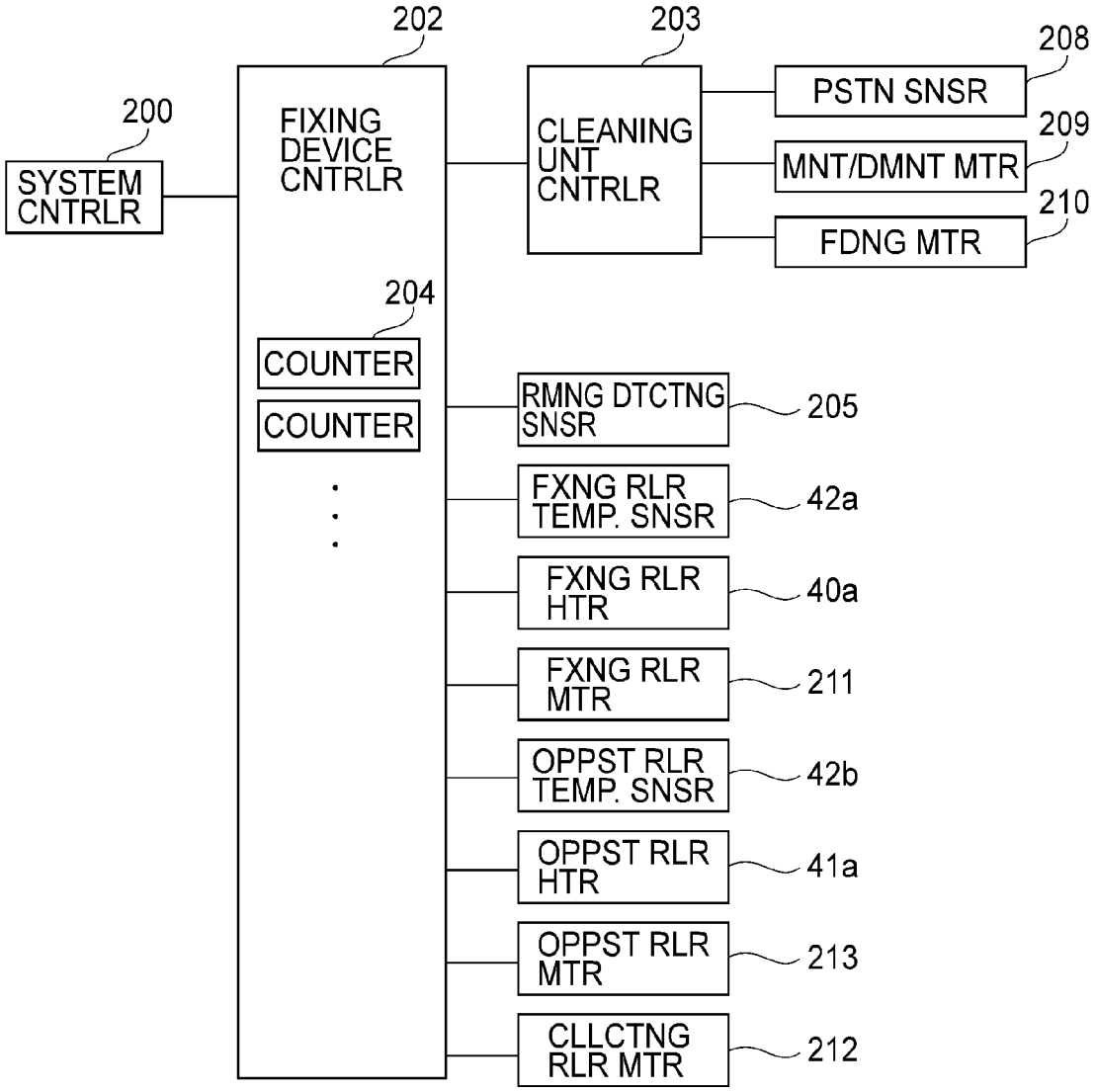
FIG. 5 is a block diagram showing a control system in the First Embodiment.

In the casing 31, a fixing roller temperature detecting sensor (detecting device) 42*a* such as a thermistor is provided so as to detect a surface temperature of the fixing roller 40 in contact with the surface of the fixing roller 40. The fixing roller temperature detecting sensor 42*a* is disposed upstream of the heating nip n3 with respect to the rotational direction of the fixing roller 40. The fixing roller temperature detecting sensor 42*a* is connected with a fixing device controller 202 (FIG. 5). The fixing device controller 202 adjusts electric power supplied to the fixing roller heater 40*a* so that the surface temperature of the fixing roller 40 detected by the fixing roller temperature detecting sensor 42*a* converges to a predetermined (e.g., about 165° C.).

In the casing 31, an opposite roller temperature detecting sensor 42*b* such as a thermistor is provided so as to detect a surface temperature of the opposite roller 41 in contact with the surface of the opposite roller 41. The opposite roller temperature detecting sensor 42*b* is disposed upstream of the heating nip n3 with respect to the rotational direction of the opposite roller 41. The opposite roller temperature detecting sensor 42*b* is connected with the fixing device controller 202. The fixing device controller 202 adjusts electric power supplied to the opposite roller heater 41*a* so that the surface temperature of the opposite roller 41 detected by the opposite temperature detecting sensor 42*b* converges to a predetermined (e.g., about 140° C.).

[Cleaning Unit]

As shown in FIGS. 2 and 3, the cleaning unit 60 for cleaning the fixing roller 40 brings the collecting roller 62 as a rotatable cleaning member formed of stainless steel (SUS 303) in an outer diameter of, e.g., 20 (mm) into contact with the fixing roller 40 so as to be rotatable by rotation of the fixing roller 40. The collecting roller 62 collects the toner by rotating while sliding with the fixing roller 40. Further, the cleaning unit 60 includes a cleaning web 61 formed with a nonwoven fabric. The web 61 constitutes a cleaning web for cleaning the surface of the collecting roller 62 in contact with the collecting roller 62.

The collecting roller 62 is rotatably supported by a rotation shaft 62*a* supported at end portions by the casing 31, and is also constituted so that pressure to be applied to the fixing roller (rotatable member) 40 is capable of being switched by a pressure switching mechanism 33 as a first switching means. The pressure switching mechanism 33 is constituted by a collecting roller urging spring 95 as a first urging member, a collecting roller urging arm 94 as a first rotatable member and a collecting roller urging cam 95 as a first cam member which are described later.

The cleaning urging spring 93 is mounted at one end portion thereof on a rotation shaft 62*a* of the collecting roller 62 so as at urge the collecting roller 62 toward the fixing roller (rotatable member) 40. The collecting roller urging arm 94 rotates in a state in which the collecting roller urging arm 94 supports the other end portion of the collecting roller urging spring 93, thus changing an urging force applied to the collecting roller 62. The collecting roller urging cam 95 rotates so as to change an amount of rotation of the collecting roller urging arm 94. In such a simple constitution, the fixing device controller 202 controls an angle of rotation of the collecting roller urging cam 95, so that an operation of the pressure switching mechanism 33 can be properly controlled.

In the case where the toner is peeled off from the recording material S and is deposited as an offset toner (residual toner) on the fixing roller 40, the collecting roller 62 cleans the fixing roller 40 and collects the offset toner from the fixing roller 40. The collecting roller 62 is always contacted to the fixing roller 40 for the purpose of collecting a deposited matter such as a foreign matter on the surface of the fixing roller 40 also in a period other than during the image formation.

In this embodiment, a constitution in which the collecting roller 62 is contacted to the fixing roller 40 to clean the surface of the fixing roller 40 is employed. However, the present invention is not limited thereto, and a constitution in which the collecting roller 62 is contacted to the opposite roller 41 to clean the surface of the opposite roller 41 may also be employed. In this case, the opposite roller 41 constitutes a rotatable heating member in the present invention. Also in this case, an effect similar to that in the case where the collecting roller 62 is contacted to the fixing roller 40 can be obtained. Such a constitution is also applicable to a modified embodiment described later.

The cleaning unit 60 includes a feeding (sending) roller 64 about which a feeding end portion 61*a* of the web 61 is wound and a winding-up roller 65 for winding up a winding end portion 61*b* of the web 61 fed from the feeding roller 64. Further, the cleaning unit 60 includes a web roller (urging roller, urging member) for pressing (urging) the cleaning web 61 against the collecting roller 62. A cleaning member for cleaning the surface of the collecting roller 62 in contact with the collecting roller 62 is constituted by the web 61 and the web roller 63.

Further, the moving mechanism 32 constitutes a second switching means for switching the pressure of the web roller 63 applied to the collecting roller 62. The moving mechanism 32 switches the pressure, of the web 61 as the cleaning member and the web roller 63, applied to the collecting roller 62 as the rotatable cleaning member. The moving mechanism 32 includes, as described later, a web roller urging spring 92 and a unit urging spring 96 which are used as a second urging member, a roller supporting plate 90 as a second rotatable member, a shaft supporting hole 90*b* formed in the plate 90, a mounting-and-demounting cam 91 as a second cam member, and a compression spring. The shaft supporting hole 90*b* is formed in an elongated shape.

The web roller urging spring 92 and the unit urging spring 96 which are used as the second urging member urge the web roller 63 toward the collecting roller (rotatable cleaning member) 62. The roller supporting plate 90 as the second rotatable member rotates against or in accordance with urging forces of the web roller urging spring 92 and the unit urging spring 96, thus changing an urging force applied to the web roller 93. The mounting-and-demounting cam 91 as the second cam member rotates so as to change an amount of rotation of the roller supporting plate 90. In such a simple constitution, the fixing device controller 202 controls an angle of rotation of the mounting-and-demounting cam 91, so that the operation of the moving mechanism 32 can be properly controlled.

Such a moving mechanism 32 switches the urging force so that a second urging force is larger than a first urging force for urging the web 61 against the collecting roller 62 by the web roller 63 is an operation in a first cleaning mode described later. That is, the moving mechanism 32 switches the urging force of the web roller 63 toward the collecting roller 62 so that the second urging force for urging the web 61 against the collecting roller 62 by the web roller 63 in an operation in a second cleaning mode described later is larger than the first urging force.

In the casing 31 in FIG. 2, the roller supporting plate 90 shown in FIG. 3 is disposed in each of front and rear sides of FIG. 2 correspondingly to associated ones of end portions of the rollers 63, 64 and 65 of the cleaning unit 60. By the roller supporting plates 90 and 90 disposed in the front and rear sides, each of the web roller 63, the feeding roller 64 and the winding-up roller 65 is supported at end portions thereof. The roller supporting plates 90 are supported so as to be rotatable about the unit rotation shaft 90*a* as a fulcrum in the clockwise direction and the counterclockwise direction in FIG. 3.

The end portions of the cleaning web 61 are rotatably supported by the feeding roller 63 and the winding-up roller 65, and a web feeding motor 210 (FIG. 5) for winding up the cleaning web 61 is connected with the cleaning web 61. When the web feeding motor rotates in a winding-up direction, the winding-up roller 63 winds up the winding-up end portion 61*b*, whereby the web 61 advances in an arrow D direction to pass through the web roller 63. Then, the feeding end portion 61*a* is pulled, whereby the feeding roller 64 is rotated. As a result, the cleaning web 61 is gradually wound up in an arrow B direction.

The web roller 63 is provided so that a rotation shaft 63*a* formed of high-rigidity metal (SUS 303) penetrates through a center of the web roller 63 in order to suppress flexure (bending) when the web 61 is pressed against the collecting roller 62 by the web roller 63. Each of the roller supporting plates 90 provided in the front and rear sides is provided with the shaft supporting holes 90*b* formed at a position opposing the collecting roller 62 contacting an upper portion of the fixing roller 40. Into these shaft supporting holes 90*b*, end portions of the rotation shaft 63*a* are inserted slidably, respectively. The end portions of the rotation shaft 63*a* of the web roller 63 are urged toward the collecting roller 62 by the web roller urging springs 92 supported at one ends by the roller supporting plates 90 provided in the front and rear sides.

The web roller 63 may preferably have a nip width formed between itself and the collecting roller 62 in order to improve cleaning power by the web 61, and therefore a silicone sponge which has a heat-resistant property and which is, e.g., 30 mm in diameter is wound around the rotation shaft 63*a*. Further, this silicone sponge is coated with a FPA tube, for preventing deposition of the toner, having a thickness of, e.g., 100 μm.

At an upper portion of the roller supporting plate 90 in a side opposite from the unit rotation shaft 90*a*, the unit urging spring 96 supported at one end thereof by the casing 31 is supported at the other end thereof. At an upper-like portion of the fixing roller 40 in FIG. 3, an elliptical mounting-and-demounting cam 91 having an eccentric rotation shaft 91*a* which is one of two focuses is disposed so as to be substantially at the same level as the collecting roller 62 with respect to a horizontal direction. The roller supporting plate 90 urged in an arrow G direction by the unit urging spring 96 effects contact and separation (spacing) between the collecting roller 62 and the cleaning web 61 with the unit rotation shaft 90*a* as the fulcrum with rotation of the mounting-and-demounting cam 91 in a state in which a lower-left portion thereof is pressed against the mounting-and-demounting cam 91.

The rotation shaft 63*a* of the web roller 63 is rotatably and slidably supported by the shaft supporting hole 90*b*. An extension direction of the shaft supporting hole 90*b*, i.e., a slide direction (arrow J direction) of the rotation shaft 63*a* is a direction perpendicular to an extension direction (arrow I direction) of the nip between the web 61 (contacting the web roller 63) and the collecting roller 62.

The collecting roller 62 is supported by the casing 31 at end portions of the rotation shaft 62*a* by unshown ball bearings so that the collecting roller 62 is movable in advancing and retracting directions relative to the fixing roller 40. The collecting roller 62 is constituted so as to be pressed against the fixing roller 40, while the contact pressure thereof toward the fixing roller 40 is stepwisely switched, by the pressure switching mechanism 33 including the collecting roller urging spring 93, the collecting roller urging arm 94 and the collecting roller urging cam 95 (FIG. 4). The collecting roller cam 95 is constituted in an elliptical shape such that one of two focuses thereof is an eccentric rotation shaft 95*a*.

The collecting roller urging spring 93 consisting of a tension spring is supported at one end thereof by an end portion of the rotation shaft 62*a* of the collecting roller 62 and is supported at the other end thereof by a central portion of the collecting roller urging arm 94. By rotation of the collecting roller urging cam 95, the urging arm 94 swings about a rotation shaft 94*a* in an arrow O direction. By the swing, an operating length of the collecting roller urging spring 93 changes, so that the pressure of the collecting roller 62 applied to the fixing roller 40 is changed. A variable range of the pressure is set from 0 N to 80 N.

For example, in a state in which the toner is deposited in a large amount on the collecting roller 62, when the nip pressure between the fixing roller 40 and the collecting roller 62 is excessively high, there is a high possibility that the toner is transferred back to the fixing roller 40. For that reason, in the case where the toner is large in amount after generation of a jam or the like, the nip pressure between the collecting roller 62 and the fixing roller 40 may preferably be lowered to the possible extent. However, in order to prevent slip of the collecting roller 62, the contact pressure of the collecting roller 62 may preferably be determined so that a frictional force F2 between the cleaning web 61 and the collecting roller 62 is smaller than a frictional force F1 between the collecting roller 62 and the fixing roller 40.

Therefore, the contact pressure is determined so as to satisfy F2<F1 while lowering the nip pressure between the collecting roller 62 and the fixing roller 40 is the possible extent. In a state in which the cleaning web 61 is spaced from the collecting roller 62 ((c) of FIG. 4)), a set value of the pressure of the collecting roller urging spring 93 is ON, so that a contact state of the collecting roller 62 with the fixing roller 40 is maintained only by the self-weight of the collecting roller 62.

The collecting roller 62 is rotated by rotation of the fixing roller 40 by transmitting a driving force from the fixing roller 40 to the collecting roller 62. In a state in which the web 61 is contacted to the collecting roller 62 by the web roller 63, when the fixing roller 40 is rotated, the toner collected from the fixing roller 40 onto the collecting roller 62 by rotation of the collect 62 rotated by the rotation of the fixing roller 40 is removed by the web 61. In that case, the web 61 contacting the collecting roller 62 is gradually wound up in the arrow B direction, so that a fresh (new) portion thereof contacts the collecting roller 62 before an associated portion of the web 61 is saturated with the toner. With respect to a winding amount, during sheet passing, the web 61 is wound up in a distance of, e.g., 1 mm every 4 sheets on an A4-sized sheet basis. In this way, the winding-up roller 65 winds up the web 61 in a predetermined amount (e.g., 1 mm) every image heating of a predetermined number of sheets (e.g., 4 sheets). Further, during the operation in the cleaning mode, the winding-up roller 65 winds up the web 61 at a rate of, e.g., 0.5 mm/sec. In this way, during the recovering (process), the winding-up roller 65 winds up the web 61 in a predetermined amount (0.5 mm in width (length)) every lapse of a predetermined time (e.g., lapse of 1 sec). As a result, the collecting roller 62 can be cleaned by bringing a fresh (new) portion of the web 61 in contact with the collecting roller 61 before the associated portion of the web 61 is saturated with the toner.

In order to suppress the pulling-out phenomenon of the web 61 when the toner is deposited over the surface of the collecting roller 62 due to the jam generation or the like, the cleaning during the jam generation is made by first bringing the web 61 into contact with the collecting roller 62 at the low pressure (20N) and then by rotating the collecting roller 62. For this reason, the finishing cleaning is made in a state in which the contact pressure is further increased (40N) after the (low pressure) cleaning is made for a certain time, and therefore even when the toner is deposited in the large amount by first performing the cleaning at the low pressure, the normal reaction between the web 61 and the collecting roller 62 is lowered. As a result, the frictional force in the nip is lowered, so that the discharge (pulling-out) of the web 61 can be prevented. In this way, in this embodiment, a constitution in which the nip pressure between the web 61 and the collecting roller 62 is changed in multiple stages is employed.

For that reason, depending on a pressure N2 between the web 61 and the collecting roller 62, a pressure N1 between the collecting roller 62 and the fixing roller 40 may preferably be changed. When a friction coefficient between the web 61 and the collecting roller 62 is μ2 and a friction coefficient between the collecting roller 62 and the fixing roller 40 is μ1, these factors may only be required that the pressure N1 is small to the possible extent while satisfying: $(N2\times\mu2)<(N1\times\mu1)$.

The friction coefficient μ1 between the collecting roller 62 and the fixing roller 40 is about 0.4-0.5 in a state in which the toner is interposed between the rollers, and the friction coefficient μ2 between the web 61 and the collecting roller 62 is about 0.7-0.8 a state in which the toner is interposed between the rollers.

Therefore, the pressure N2 when the web 61 contacts the collecting roller 62 at the low pressure position is 20N, and therefore in order to satisfy: $(N2\times\mu2)<(N1\times\mu1)$, the pressure N1 is set at 45N (i.e., $(0.8\times40\text{ N})<(0.4\times45\text{N})$).

When the finishing cleaning is made, the contact pressure of the web 61 is 40N, and therefore in order to satisfy: $(N2\times\mu2)<(N1\times\mu1)$, the pressure N1 is set at 90N (i.e., $(0.8\times40\text{N})<(0.4\times90\text{N})$).

In a state in which the web 61 is spaced from the collecting roller 62, a set value of the pressure of the collecting roller urging spring 93 is 0N, so that a contact state of the collecting roller 62 with the fixing roller 40 is maintained only by the self-weight of the collecting roller 62.

The collecting roller 62 is rotated by the rotation of the fixing roller 40 by transmitting thereto the drive (driving force) from the fixing roller 40 with the rotation of the fixing roller 40. By rotationally driving the fixing roller 40 in a state in which the web 61 is contacted to the fixing roller 40 by the web roller 63, the collecting roller 62 is rotated, so that the toner, collected from the fixing roller 40, remaining on the collecting roller 62 is removed by the cleaning web 61. The cleaning web 61 contacting the collecting roller 62 is set so that the web 61 gradually wound up in the arrow B direction (FIG. 3) and thus a fresh portion of the web 61 is contacted to the collecting roller 62 before the associated portion of the web 61 is saturated with the toner.

Next, with reference to FIG. 5, a control system in this embodiment will be described. FIG. 5 is a block diagram showing the control system for effecting contact-and-separation control of the cleaning unit 60 in this embodiment.

That is, the printer 16 (FIG. 1) includes an entire system controller 200 for effecting integral control of the respective portions, and the fixing device controller 202 is connected with the entire system controller 200.

In the fixing device controller 202, a plurality of counters 204 are provided. To the fixing roller controller 202, a cleaning unit controller 203, a remaining detecting sensor 205, the fixing roller temperature detecting sensor 42*a*, the fixing roller heater 40*a* and the fixing roller motor 211 are connected. Further, to the fixing device controller 202, an opposite roller temperature detecting sensor 42*a*, the opposite roller heater 41*a*, an opposite roller motor 213 and a collecting roller mounting-and-demounting motor 212 are connected.

To the unit controller 203 described above, a home position sensor 208 for detecting a home position of the web roller 63 relative to the collecting roller 62 and a web mounting-and-demounting motor 209 for mounting and demounting the web 61 relative to the collecting roller 62 by rotating the mounting-and-demounting cam 91 are connected. Further, to the unit controller 203, the web feeding motor 210 for winding up the web 61 by rotating the winding-up roller 65 is connected.

The fixing device controller (control means) 202 effects the following control in accordance with an instruction from the entire system controller 200, on the basis of detection signals from the fixing roller temperature detecting sensor 42*a* and the opposite roller temperature detecting sensor 42*b*. That is, the controller 202 contacts not only the cleaning unit 60 via the cleaning unit controller 203 but also each of the fixing roller heater 40*a*, the fixing roller motor 211, the collecting roller mounting-and-demounting motor 212, the opposite roller heater 41*a* and the opposite roller motor 213.

The fixing device controller 202 is constituted so that an operation in a first cleaning mode ((a) of FIG. 4), an operation in a second cleaning mode ((b) of FIG. 4), and an operation in a separation mode ((c) of FIG. 4) are executable. In the operation in the first cleaning mode ((a) of FIG. 4), by controlling the pressure switching mechanism (first switching means) 33 and the moving mechanism (second switching means) 32, the collecting roller (rotatable collecting member) 62 is contacted to the fixing roller (rotatable member) 40 at a first pressure (low pressure: e.g., 20N).

In the operation in the second cleaning mode ((b) of FIG. 4), by controlling the pressure switching mechanism 33 and the moving mechanism 32, the collecting roller (rotatable cleaning member) 62 can be contacted to the fixing roller (rotatable member) 40 at a second position (high pressure: e.g., 45N) higher than the first position. In the operation in the separation mode, by controlling the pressure switching mechanism 33 and the moving mechanism 32, the web roller 63 is spaced from the collecting roller 62.

In this embodiment, in both of the operations in the first cleaning mode and the second cleaning mode, the frictional forces are set so that the first frictional force (F1 in FIG. 2) between the collecting roller 62 and the fixing roller 40 is larger than the second frictional force (F2 in FIG. 2). The second frictional force is the frictional force between the web 61 as the cleaning member and the collecting roller 62 as the rotatable cleaning member. Further, the frictional forces are set via the pressure switching mechanism 33 and the moving mechanism 32 so that the first frictional force (F1 in FIG. 2) is larger than the second frictional force (F2 in FIG. 2) in both of the operations in the first and second cleaning modes.

The cleaning unit controller 203 rotates the mounting-and-demounting cam 91 by driving the web mounting-and-demounting motor 209 while discriminating the position of the web roller 63 relative to the collecting roller 62 by the home position sensor 209. At the same time, the web 61 is mounted on and demounted from the collecting roller 62 while being wound up by drive of the web feeding motor 210.

The remaining detecting sensor 205 detects the recording material S remaining in the fixing device 9 during jam generation or the like, and then sends a detection signal of the recording material S to the fixing device controller 202.

The fixing roller temperature detecting sensor 42*a* detects the surface temperature of the fixing roller 40, and then sends its detection signal to the fixing device controller 202.

A heat generation temperature of the fixing roller heater 40*a* is adjusted by control by the fixing device controller 202, so that the surface temperature of the fixing roller 40 is adjusted, but adjusts the surface temperature of the collecting roller (rotatable cleaning member) 62 on the basis of the surface temperature of the fixing roller 40. The fixing roller motor 211 rotates the fixing roller 40 in the arrow K direction in FIG. 2 by the control by the fixing device controller 202.

The opposite roller temperature detecting sensor 42*b* detects the surface temperature of the opposite roller 41, and then sends its detection signal to the fixing device controller 202. A heat generation temperature of the opposite roller heater 31*a* is adjusted by the control by the fixing device controller 202, so that the opposite roller heater 41*a* adjusts the surface temperature of the opposite roller 41. The opposite roller motor 213 rotates the opposite roller 41 in the arrow L direction in FIG. 2 by the control by the fixing device controller 202.

The fixing device controller 202 rotates the collecting roller urging cam 95 by driving the collecting roller mounting-and-demounting motor 212 while discriminating the position of the collecting roller 62 relative to the fixing roller 40, so that the collecting roller 62 is contacted to and spaced from the fixing roller 40.

Figure 6:
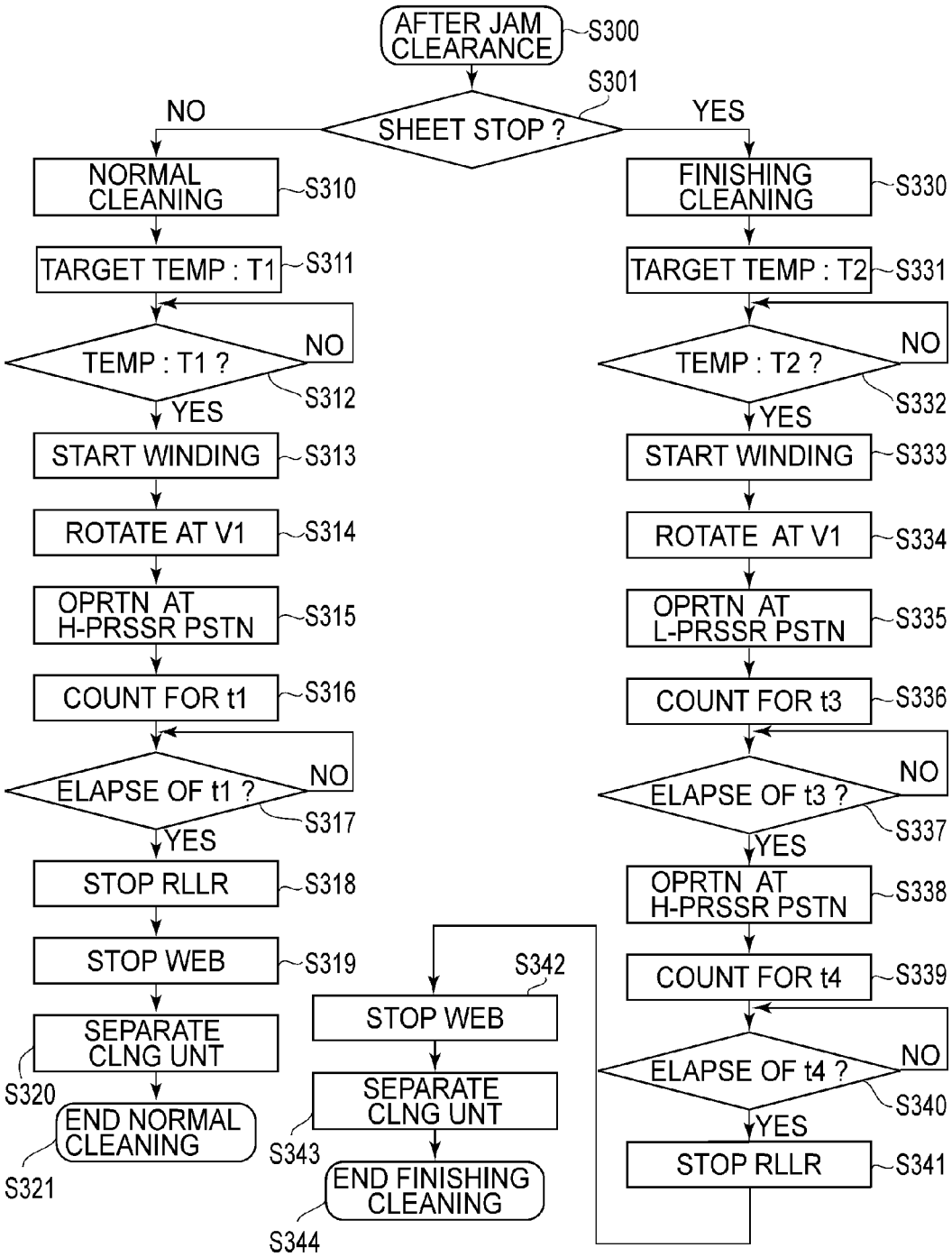
FIG. 6 is a flowchart relating to a cleaning process in the First Embodiment.

Next, the action (function) of this embodiment will be described with reference to FIGS. 4 and 6. FIG. 6 is a flowchart for illustrating a process of carrying out normal cleaning, low pressure cleaning and high pressure cleaning.

That is the fixing device controller 202 executed in accordance with an instruction from the entire system controller 200 detects, via the remaining detecting sensor 205, whether or not the recording material S exists in the fixing device 9 during the jam generation.

In the case where absence of the recording material S in the fixing device becomes clear after jam clearance (S300) ("NO" of S301), normal cleaning is started (S310).

In the normal cleaning, first, the fixing device controller 202 turns on the fixing roller heater 40*a* provided inside the fixing roller 40, and the temperature of the fixing roller 40 is increases so as to become a target temperature T1 (140° C.) while being measured by the fixing roller temperature detecting sensor 42*a* (S311). Then, when the surface temperature of the fixing roller 40 reaches the target temperature T1 (140° C.) ("YES" of S312), the fixing device controller 202 starts a web-up operation of winding-up the web 61 (S313). By drive of the web feeding motor 21, the winding-up end portion 61*b* of the web 61 is wound up about the winding-up roller 65 at a speed of 1.0 mm/sec. Subsequently, rotation of the fixing roller 40 is started at a speed V1 (e.g., 200 mm/sec) (S314), so that the collecting roller 62 is rotated by the rotation of the fixing roller 40. Therefore, the rotational speed of the collecting roller 62 equals to the speed V1 (200 mm/sec).

Thereafter, a mounting operation of mounting the cleaning unit 60 and a pressing operation of pressing the collecting roller 62 are started at a high pressure position, and the mounting-and-demounting cam 91 is rotated to a position where a nip pressure (N2) between the web roller 63 and the collecting roller 62 is 40N, so that the web 61 is contacted to the collecting roller 62. At the same time, the urging cam 95 is rotated so that a pressure N1 between the collecting roller 62 and the fixing roller 40 is 90N (S315). Hereinafter, this position is referred to as the high pressure position ((a) of FIG. 4). In this case, $(N2\times\mu2)<(N1\times\mu1)$ holds, and therefore the slip of the collecting roller 62 with the fixing roller 40 can be prevented. Further, jammed paper is in a state in which the jammed paper does not exist in the fixing device ("NO" of S301), and therefore also the amount of the toner on the collecting roller 62 is small. Accordingly, even when the pressure of the collecting roller 62 is increased, the transfer-back of the toner onto the fixing roller 40 does not generate.

The fixing device controller 202 starts count of the cleaning for a certain time t1 (e.g., 40 sec) by a counter 204 (S316). Then, when the counter 204 reaches the certain time t1 ("YES" of S317), the rotation of the fixing roller 40 is stopped (S318), and then the web feeding motor 210 is stopped, and thus the winding-up of the web 61 is stopped (S319).

Thereafter, the fixing device controller 202 starts a separating (spacing) operation of separating (spacing) the cleaning unit 60 and a pressure-reducing operation of the collecting roller 62 (S320). Then, when the cleaning unit 60 reaches a separated (spaced) position and the collecting roller urging cam 95 reaches a position where the pressure of the collecting roller urging spring 92 for the collecting roller 62 is 0N ((c) of FIG. 4), a normal cleaning flow is ended (S321).

On the other hand, during jam generation, in the case where the controller 202 discriminates, via the remaining detecting sensor 205, that the recording material S remains in the fixing device ("YES" of S301), the fixing device controller 202 starts low pressure and finishing cleaning (S330).

In the case where the jam generates in the fixing device due to improper separation of the recording material S or the like, the recording material S adheres to the fixing roller 40 or the collecting roller 62, so that the toner is deposited over the surface of the collecting roller 62 in some cases. After the jam, when the collecting roller 62 is rotationally driven for cleaning the collecting roller 62 in a state of contact of the web 61 with the collecting roller 62 at a pressure of not less than a certain value, there is liability that the toner is transferred back in a large amount onto the fixing roller 40. Further, there is a possibility that the web 61 is pulled due to a viscoelastic property and an adhesive property of the toner deposited on the collecting roller 62, so that the web 61 is reversely rotated, and thus the web 61 is pulled out.

A one-way gear (not shown) for preventing reverse rotation is provided at the winding-up end portion 61*b*, and therefore a center shaft of the web-up end portion 61*b* is not rotated, but when the web 61 remains in a large amount in the web-up side, there is a possibility that the web 61 is pulled out while being tightly squeezed. When the winding-up side web 61 is pulled out, the web 61 becomes entangled with the collecting roller 62 or the fixing roller 40, so that there is a possibility that tearing of the web 61, breakage of the fixing roller 40 and breakage of the sensors and the respective members which contact the fixing roller 40 are caused to generate.

Therefore, by first cleaning the collecting roller 62 at the low pressure, the normal reaction between the web 61 and the collecting roller 62 is lowered even when the toner is deposited in the large amount on the collecting roller 62, so that the frictional force in the nip can be lowered, and thus it is possible to prevent the web 61 from being discharged (pulled out).

Further, the collecting roller 62 is rotated by the fixing roller 40, and therefore, it is preferable that the frictional force F1 between the collecting roller 62 and the fixing roller 40 is higher during the drive than the frictional force F2 between the web 61 and the collecting roller 62 (i.e., $(N2\times\mu2)<(N1\times\mu1)$).

Further, when the toner exists in the large amount on the collecting roller 62, when the nip pressure (N1) between the collecting roller 62 and the fixing roller 40 is in a high state the toner collected from the fixing roller 40 is transferred back onto the fixing roller 40. For that reason, it is preferable that the pressure N1 is minimized while satisfying: $(N2\times\mu2)<(N1\times\mu1)$.

Therefore, the pressure N2 when the web 61 contacts the collecting roller 62 at the low pressure is 20N, and therefore in order to satisfy: $(N2\times\mu2)<(N1\times\mu1)$, the collecting roller urging cam 95 is rotated so that the pressure N1 is 45N. As a result, the urging force of the collecting roller urging spring 93 is adjusted $((0.8\times20N)<(0.4\times45N))$.

First, the fixing device controller 202 turns on the fixing roller heater 40*a* in the fixing roller 40, and controls the turning-on of the fixing roller heater 40*a*, while measuring the surface temperature of the fixing roller 40 by the temperature detecting sensor 42*a*, so that the surface temperature is a target temperature T1 (e.g., 140° C.) (S331). When the temperature of the fixing roller 40 reaches the target temperature T2 (140° C.) ("YES" of S332), the controller 202 starts a web-up operation of winding-up the web 61 (S333). The fixing device controller 202 drives the web feeding motor 21, so that the winding-up end portion 61*b* of the web 61 is wound up about the winding-up roller 65 at a speed of, e.g., 1.0 mm/sec.

Subsequently, rotational drive of the fixing roller 40 is started at a speed V1 (e.g., 200 mm/sec) (S334), so that the collecting roller 62 is driven by the rotational drive of the fixing roller 40. Therefore, the rotational speed of the collecting roller 62 equals to the speed V1 (200 mm/sec).

Thereafter, the fixing device controller 202 starts a mounting operation of mounting the cleaning unit 60 and a pressing operation of pressing the collecting roller 62, and rotates the mounting-and-demounting cam 91 to a position where a nip pressure (N2) between the web roller 63 and the collecting roller 62 is, e.g., 20N, so that the web 61 is contacted to the collecting roller 62 (S335). At the same time, the urging cam 95 is rotated so that a pressure between the collecting roller 62 and the fixing roller 40 is, e.g., 45N (S335). Hereinafter, this position is referred to as the low pressure position ((b) of FIG. 4).

Then, the fixing device controller 202 carries out the cleaning for a certain time t3 (e.g., 20 sec) counted by the counter 204 (S336). Then, when the counter 204 reaches the certain time t3 ("YES" of S337), the cleaning unit 60 is moved as follows. That is, the cleaning unit 60 is moved to the high pressure position ((a) of FIG. 4) where the nip pressure (N2) between the web roller 63 and the collecting roller 62 is, e.g., 40N and the nip pressure (N1) between the collecting roller 62 and the fixing roller 40 is, e.g., 90N (S338), and then finishing cleaning is started.

As described above, the fixing device controller 202 as an executing portion executes the operation in the cleaning mode, during the restoring process after the jam clearance, in such a manner that the collecting roller 62 is cleaned at the low pressure position (in the operation in the first cleaning mode) shown in (b) of FIG. 4 and at the high pressure position (in the operation in the second cleaning mode) shown in (a) of FIG. 4 in the listed order. In a low pressure state, when the cleaning is made to some extent, the toner, in a very small amount, which cannot be completely removed at the low pressure remains on the surface of the collecting roller 62. In order to clean the surface of the collecting roller 62, after the cleaning for the certain time at the low pressure, the contact pressure is increased and the finishing cleaning is carried out for a certain time, so that the residual toner can be properly removed.

When the toner is deposited on the collecting roller 62 as it is, the toner is deposited again on the collecting roller 62, so that an image defect generates. Further, when the collecting roller 62 is kept at the low pressure position, the collecting roller 62 slips with the fixing roller 40, and therefore when the contact pressure of the web 61 is increased, also the contact pressure between the collecting roller 62 and the fixing roller 40 is required to be increased correspondingly.

The fixing device controller 202 carried out the cleaning for a certain time t4 (40 sec) by a counter 204 (S339), and then, when the counter 204 reaches the certain time t4 ("YES" of S340), the rotation of the fixing roller 40 is stopped (S341). Then, the web feeding motor 210 is stopped, and thus the winding-up of the web 61 is stopped (S342). Thereafter, the controller 202 starts a separating (spacing) operation of separating (spacing) the cleaning unit 60 and a pressure-reducing operation of the collecting roller 62 (S343). Then, at the time when the cleaning unit 60 reaches a separated (spaced) position and the collecting roller urging cam 95 reaches a position where the pressure of the collecting roller urging spring 92 for the collecting roller 62 is 0N ((c) of FIG. 4), a low pressure and finishing cleaning flow (sequence) is ended (S344).

<Second Embodiment>

Next, with reference to (a) and (b) of FIG. 7, Second Embodiment of the present invention will be described. In this embodiment, members identical to those in First Embodiment are represented by the same reference numerals or symbols, and constitutions and functions of the members are the same as those in the above-described embodiment will be omitted from description. This embodiment is substantially the same as First Embodiment except that a collecting roller urging spring 97 (FIG. 7) or the like is provided in place of the pressure switching mechanism 33 and the web roller urging spring 92 which are shown in FIG. 3 and which are omitted from this embodiment and that first and second pressing portions 90*e* and 90*f* for pressing the urging spring 97 are provided.

That is, in this embodiment, in the moving mechanism 32 side, the mounting-and-demounting cam 91, the web roller urging spring 92 and the unit urging spring 96 which are shown in FIG. 3 in First Embodiment are similarly used. Further, in this embodiment, in the pressure switching mechanism 33 side (FIG. 3), none of the collecting roller urging spring 93, the collecting roller arm 94 and the collecting roller urging cam 95 is used, and in place of these members, the collecting roller urging spring 97 shown in (a) and (b) of FIG. 7 is used.

Figure 7:
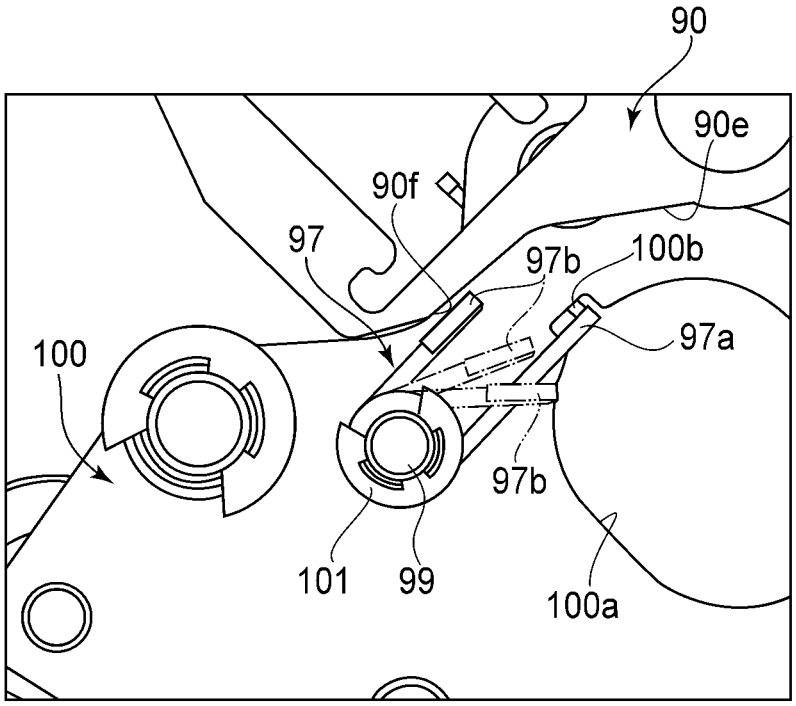
In FIGS. 7,(*a*) and (*b*) are schematic views for illustrating an operating state of a pressing portion in a Second Embodiment.
Figure 7:
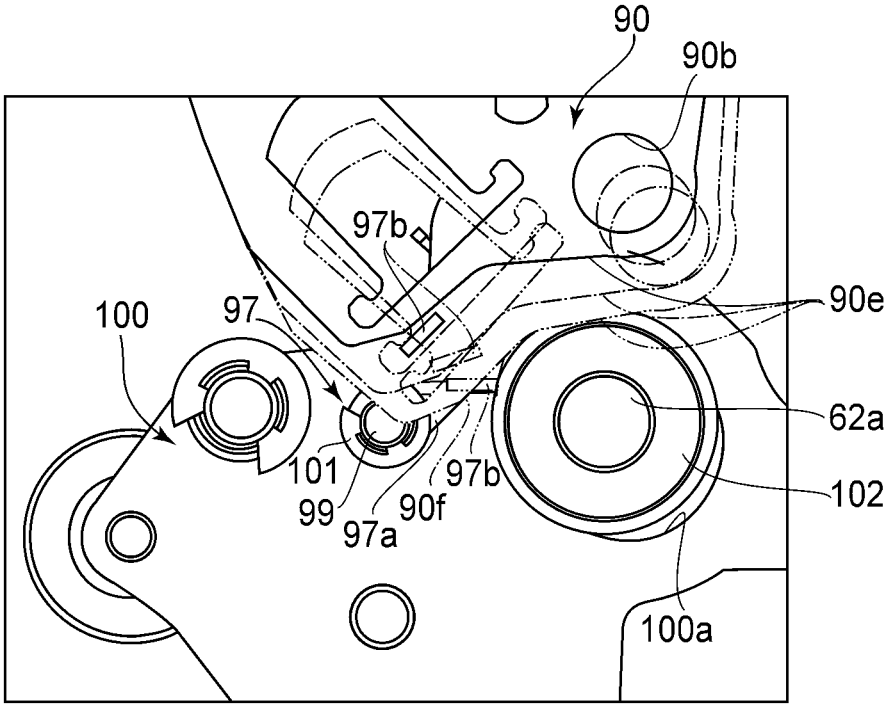

In this embodiment, as shown in (a) and (b) of FIG. 7, a roller supporting member 100 for supporting the collecting roller 62 and the fixing roller 40 is provided. The roller supporting member 100 is provided with an opening 100*a* through which the rotation shaft 62*a* of the collecting roller 62 is supported via a bearing 102. The opening 100*a* is formed in an elliptical shape inclined from an upper-left portion toward a lower-right portion in (a) and (b) of FIG. 7. In a state in which the rotation shaft 62*a* is rotatably supported by the bearing 102, the collecting roller 62 is supported so as to be movable in an oblique direction in the opening 100*a* and is also urged by an unshown urging member toward the upper-left portion in the opening 100*a*.

In the neighborhood of the opening 100*a* of the roller supporting member 100, a spring supporting shaft 99 is fixed so as to project toward the front side on the drawing sheet of (a) and (b) of FIG. 7. On the spring supporting shaft 99, the collecting roller urging spring 97 as an urging portion is mounted so that a coil portion thereof is wound around the spring supporting shaft 99. The collecting roller urging spring 97 is constituted by a coil-shaped torsion spring and functions so as to urge the collecting roller 62 toward the fixing roller 40.

The roller supporting member 100 includes a locking portion 100*b* formed at an upper portion of the opening 100*a*. The collecting roller urging spring 97 wound at the coil portion thereof about the spring supporting shaft 99 is engaged at one end portion 97*a* thereof with the locking portion 100*b* from below so that the end portion 97*a* is contactable to an outer peripheral surface of the bearing 102 projected from the opening 100*a*. In this state, the other end portion 97*b* of the collecting roller urging spring 97 is open as a free end portion. The other end portion 97*b* is formed in a length shorter than the length of the end portion 97*a*.

In this embodiment, a shaft supporting hole 90*b* provided in the roller supporting plate 90 is constituted in a circular shape, not the elongated shape as in First Embodiment. With this circular shaft supporting hole 90*b*, the rotation shaft 63*a* (FIG. 4) of the web roller 63 is freely engaged via an unshown bearing. In this embodiment, a constitution in which an approaching operation of the web roller 63, toward the collecting roller 62, supported rotatably the circular shaft supporting hole 90*b* and supported immovably in a radial direction of the shaft supporting hole 90*b* is absorbed in a side where the collecting roller 62 is urged obliquely upward in the opening 100*a* is employed.

The moving mechanism 32 in this embodiment moves the cleaning unit 60 relative to the collecting roller 62 so that the cleaning unit 60 is movable between a first position where the web 61 contacts the collecting roller 62 and a second position where the web 61 contacts the collecting roller 62 at a contact pressure lower than a contact pressure at the first position. This moving operation is, similarly as in First Embodiment, properly controlled by the fixing device controller 202 by controlling the angle of rotation of the mounting-and-demounting cam 91 by the fixing device controller 202.

The unit 60 in this embodiment includes the first pressing portion 90*e* for pressing the collecting roller 62 in contact with the collecting roller 62 when the unit 60 is in the first position, and includes the second pressing portion 90*f* for pressing the collecting roller 62 via the collecting roller urging spring (urging portion) 97 when the unit 60 is in the second position. In a state in which the collecting roller 62 is not urged by the first and second pressing portions 90*e* and 90*f*, the bearing 102 is contacted to an upper and inner peripheral portion of the opening 100*a* and is kept at the position, and thus the collecting roller 62 is constituted so as to be in the spaced state similarly as in the state of (c) of FIG. 4.

When the cleaning unit 60 (FIG. 3) is in the first position, the collecting roller 62 is urged so that the frictional force F2 between the collecting roller 62 and the web 61 is smaller than the frictional force F1 between the collecting roller 62 and the fixing roller 40. The first position is similar to the high pressure position shown in (a) of FIG. 4. At the first position, in (a) of FIG. 7, when the other end portion 97*b* is strongly pushed by the first pressing portion 90*e* to a position indicated by a chain double-dashed line ((b) of FIG. 7), the first pressing portion 90*e* of the roller supporting plate 90 directly contacts and presses the bearing 102.

In this case, the other end portion 97*b* is strongly pushed in, and the bearing 102 is further strongly pushed in the end portion 97*a*, so that the web roller 63 is contacted to the collecting roller 62 at the high pressure with movement of the roller supporting plate 90. As a result, the frictional force F1 generates between the collecting roller 62 and the fixing roller 40. Accordingly, the frictional force F2 generated between the collecting roller 62 and the web 61 by the contact of the web roller 63 with the collecting roller 62 caused only by movement of the roller supporting plate 90 is smaller than the frictional force F1 to which the urging force of the urging spring 97 is added, so that the relationship of F2<F1 is maintained.

On the other hand, when the cleaning unit 60 (FIG. 3) is in the second position, the collecting roller 62 is urged via the collecting roller urging spring (urging portion) 97 so that the frictional force F2 between the collecting roller 62 and the web 61 is smaller than the frictional force F1 between the collecting roller 62 and the fixing roller 40. That is, at this time, the cleaning unit 60 is in a state in which the cleaning unit 60 contacts the collecting roller urging spring 97 without contacting the collecting roller 62. The second position is similar to the low pressure position shown in (b) of FIG. 4. In (a) of FIG. 7, when the other end portion 97*b* is strongly pushed by the second pressing portion 90*f* to a position indicated by a chain line ((b) of FIG. 7), the end portion 97*a* rotating in the clockwise direction in the figure presses the bearing 102, so that the second position is obtained. That is, when the cleaning unit 60 is in this position, the roller supporting plate 90 (90*f*) urges the bearing 102 only via the collecting roller urging spring 97.

In this case, the other end portion 97*b* is weakly pushed in, and the bearing 102 is weakly pushed in the end portion 97*a*, so that the web roller 63 is contacted to the collecting roller 62 at the low pressure with movement of the roller supporting plate 90. As a result, the frictional force F1 generates between the collecting roller 62 and the fixing roller 40. Accordingly, the frictional force F2 generated between the collecting roller 62 and the web 61 by the contact of the web roller 63 with the collecting roller 62 caused only by movement of the roller supporting plate 90 is smaller than the frictional force F1 to which the urging force of the urging spring 97 is added. For that reason, also in this case, the relationship of F2<F1 is maintained.

Further, a position similar to the separated position shown in (c) of FIG. 4 is obtained by positioning the second pressing portion 90*f* at a solid-line position, in (a) and (b) of FIG. 7, where the second pressing portion 90*f* does not contact the other end portion 97*b*.

As described above, the first position, the second position and the separated position can be obtained simply and reliably only by changing the positions of the first and second pressing portions 90*e* and 90*f* relative to the collecting roller urging spring 97 and the bearing 102 in the moving operation of the above-described plate 90 on the basis of the control of the mounting-and-demounting cam 91. As a result, it becomes possible to suppress the slip of the collecting roller 62 while avoiding the transfer-back of the toner from the collecting roller 62 onto the fixing roller 40.

Also in this embodiment, the fixing device controller 202 as an executing portion executes the operation in the cleaning mode, during the restoring process after the jam clearance, in such a manner that the collecting roller 62 is cleaned at the low pressure position (second position shown in (b) of FIG. 4) and at the high pressure position (first position shown in (a) of FIG. 4) in the listed order. In a low pressure state, when the cleaning is made to some extent, the toner, in a very small amount, which cannot be completely removed at the low pressure remains on the surface of the collecting roller 62. In order to clean the surface of the collecting roller 62, after the cleaning for the certain time at the low pressure, the contact pressure is increased and the finishing cleaning is carried out for a certain time, so that the residual toner can be properly removed.

Also in this embodiment, the web 61 contacting the collecting roller 62 is gradually wound up, so that the fresh portion contacts the collecting roller 62 before the associated portion of the web 61 is saturated with the toner. With respect to a winding amount, during sheet passing, the web 61 is wound up in a distance of, e.g., 1 mm every 4 sheets on an A4-sized sheet basis. In this way, the winding-up roller 65 winds up the web 61 in a predetermined amount (e.g., 1 mm) every image heating of a predetermined number of sheets (e.g., 4 sheets). Further, during the operation in the cleaning mode, the winding-up roller 65 winds up the web 61 at a rate of, e.g., 0.5 mm/sec. In this way, during the recovering (process), the winding-up roller 65 winds up the web 61 in a predetermined amount (e.g., 0.5 mm in width (length)) every lapse of a predetermined time (e.g., lapse of 1 sec). As a result, the collecting roller 62 can be cleaned by bringing a fresh (new) portion of the web 61 in contact with the collecting roller 61 before the associated portion of the web 61 is saturated with the toner.

<Third Embodiment>

Next, with reference to FIG. 8, Third Embodiment of the present invention will be described. In this embodiment, members identical to those in First Embodiment are represented by the same reference numerals or symbols, and constitutions and functions of the members are the same as those in the above-described embodiment will be omitted from description.

Figure 8:
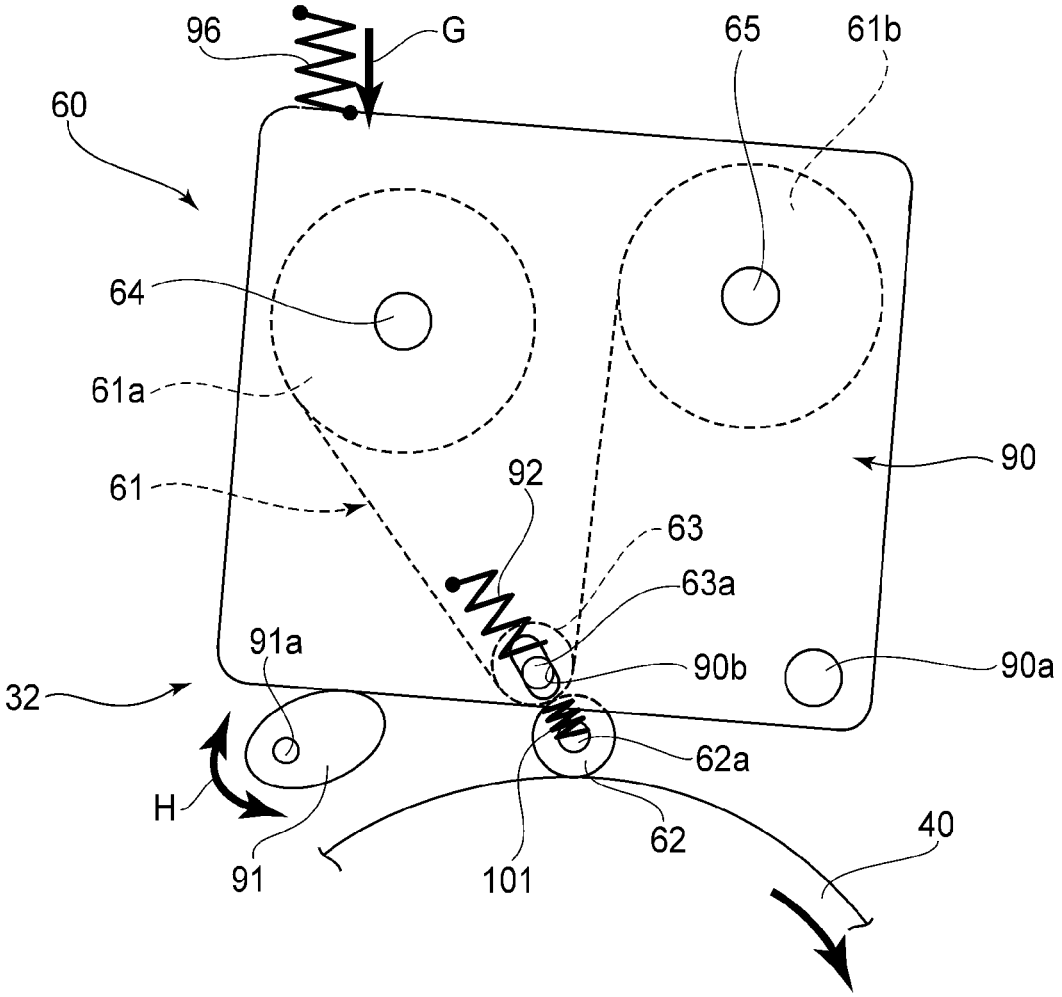
FIG. 8 is a schematic view showing a moving mechanism for moving a web roller toward and away from a collecting roller in a Third Embodiment.

In this embodiment, as shown in FIG. 8, in a pressing method of the collecting roller 62, a constitution in which the collecting roller 62 is pressed toward the fixing roller without using the collecting roller urging arm 94 and the collecting roller urging cam 95 and the like is employed. That is, in a state in which a lower end portion of a collecting roller urging spring 101 provided at a position of being pressed by the roller supporting plate 90 of the cleaning unit 60 is contacted to the rotation shaft 62*a* of the collecting roller 62, an upper end portion of the collecting roller urging spring 101 is pressed by the roller supporting plate 90. As a result, the collecting roller 62 is pressed toward the fixing roller 40.

In this embodiment, a spring movable to a position by the roller supporting plate 90 changed in position depending on the low pressure position and the high pressure position of the cleaning unit 60 is selected and used as the collecting roller urging spring 101. For this reason, a simpler constitution can be realized, so that even in the case where the contact pressure of the web 61 is changed in the multiple stages, it is possible to suppress the transfer-back of the toner from the collecting roller 62 onto the fixing roller 40, damage on and generation of the recessed portion of the fixing roller 40, and the slip of the collecting roller 62. As a result, it becomes possible to provide the printer 16 capable of realizing a stable end product.

As described above, according to First to Third Embodiments, even in a state in which the toner is deposited over the surface of the collecting roller 62 after the jam generation or the like, the collecting roller 62 can be cleaned properly without pulling out the web 61. Further, the web 61 has a constitution in which the contact pressure thereof varies in the multiple stages in order to prevent the pulling-out thereof, and therefore by setting also the contact pressure of the collecting roller 62 so as to vary in the multiple stages depending on the contact pressure of the web 61, it is possible to lower the pressure of the collecting roller 62 while maintaining the relationship of F2<F1. As a result, it is possible to prevent the transfer-back of the toner from the collecting roller 62 onto the fixing roller 40 and the slip of the collecting roller 62, so that the damage on and generation of the recessed portion of the fixing roller 40 can be suppressed and thus it becomes possible to provide a stable end product for a long term.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 045862/2014 filed Mar. 10, 2014, which is hereby incorporated by reference.

What is claimed is:

1. An image heating apparatus comprising:

a heat rotatable member configured to heat a toner image on a recording material;

a collecting roller configured to collect a toner deposited on said heat rotatable member while being rotated by said heat rotatable member;

a bearing configured to rotatably support a longitudinal end portion of said collecting roller;

a holding member configured to hold said bearing;

a spring provided on said holding member and configured to act on said bearing by contacting said bearing;

a cleaning unit including a cleaning web configured to clean said collecting roller member; and a moving mechanism configured to move said cleaning unit so as to be movable between a first position where said cleaning web contacts said collecting roller and a second position where said cleaning web contacts said collecting roller at a contact pressure lower than a contact pressure at the first position, wherein said cleaning unit includes (i) a first pressing portion configured to press said collecting roller toward said heat rotatable member by contacting said bearing when said cleaning unit is in the first position, and (ii) a second pressing portion configured to press said collecting roller toward said heat rotatable member by contacting said spring without contacting said bearing when said cleaning unit is in the second position.

2. The image heating apparatus according to claim 1, wherein said second pressing portion presses said collecting roller via said spring so that the frictional force between said collecting roller and said cleaning web is smaller than the frictional force between said collecting roller and said heat rotatable member.

3. The image heating apparatus according to claim 1, wherein said first pressing portion presses said collecting roller so that the frictional force between said collecting roller and said cleaning web is smaller than the frictional force between said collecting roller and said heat rotatable member.

4. The image heating apparatus according to claim 1, further comprising an executing portion configured to execute an operation in a cleaning mode in which said collecting roller is cleaned at the second position and the first position in this order during a recovery process after jam clearance.

5. The image heating apparatus according to claim 1, wherein said cleaning unit includes a roller about which said cleaning web is wound and a winding up roller configured to wind up said cleaning web, and wherein said winding up roller winds up a predetermined amount of said cleaning web for every image heating of a predetermined number of sheets.

6. The image heating apparatus according to claim 1, wherein said cleaning unit includes a roller about which said cleaning web is wound and a winding up roller configured to wind up said cleaning web, and wherein said winding up roller winds up a predetermined amount of said cleaning web for every lapse of a predetermined time.

7. The image heating apparatus according to claim 1, wherein said collecting roller is in contact with said heat rotatable member when said cleaning unit is in the first position and the second position.

* * * * *